US005139398A

United States Patent [19]

Downing

[11] Patent Number: 5,139,398

[45] Date of Patent: Aug. 18, 1992

[54] NEUTRALIZER VALVE FOR A DOWNHOLE PUMP

[75] Inventor: Donald R. Downing, Vernal, Utah

[73] Assignee: D & L Valve, Inc., Vernal, Utah

[21] Appl. No.: 682,467

[22] Filed: Apr. 8, 1991

[51] Int. Cl.[5] ..... F04B 21/06

[52] U.S. Cl. ..... 417/511; 417/514; 417/520; 417/552

[58] Field of Search ..... 417/511, 512, 513, 514, 417/520, 510, 552, 547, 444

[56] References Cited

U.S. PATENT DOCUMENTS

| | | | |
|---|---|---|---|
| 243,438 | 6/1881 | Dunlap | 417/552 |
| 2,304,237 | 12/1942 | Bridwell | 417/511 X |
| 4,087,212 | 5/1978 | Holder | 417/511 X |
| 4,504,199 | 3/1985 | Spears | 417/514 X |

*Primary Examiner*—Leonard E. Smith
*Attorney, Agent, or Firm*—M. Reid Russell

[57] ABSTRACT

A neutralizer valve that is for use in conjunction with one or more reciprocating pumps of a tubing string that is operated in an oil well for recovery of crude oil. The neutralizer valve takes the place of a regular traveling valve in a rod pump, which includes a drag plunger for passing a crude and natural gas mix therethrough on a down stroke of the tubing string. The neutralizer valve includes a guide barrel that connects into the rod pump plunger and contains a ported seal stem that is arranged to move up and down therein. The ported seal stem includes a keyed rod as its upper end that is for fitting to travel up and down in a keyway that is formed through a ported disk which is arranged across the guide barrel interior. The ported seal stem includes a collar formed around its mid-section, the undersurface of which collar is a valve face that is for engaging, so as to seal against a seat that is maintained in the guide barrel. Which ported seal stem is ported below the collar into a center longitudinal passage that opens at the stem bottom end face. The ported seal stem bottom lend is threaded to receive a coupling collar that is turned thereover for connecting it to a drag plunger of the downhole pump. On an up stroke of the rod tubing string the valve closes, creating a void between it and a standing valve of a downhole pump. On a down stroke, the stem collar valve face is moved off the seat, opening the valve to allow a fluid flow therethrough.

6 Claims, 2 Drawing Sheets

NEUTRALIZER VALVE FOR A DOWNHOLE PUMP

BACKGROUND OF THE INVENTION

1. Field of the Invention

This invention relates to valves for use with a rod pump for venting fluid and gas passed up a tubing string during oil well pumping operations.

2. Prior Art

Crude oil production, particularly from old oil wells, often requires the use of artificial lift means by which the crude oil is lifted from the well bore to the surface. For this purpose a number of downhole pumps have been developed. All of which pumps are subject to gas lock when they encounter and pump a mix of crude oil and natural gas solubilized therein. Gas locking is a common phenomenon that occurs within a pump that is moving a formation fluid where separation of the natural from the crude occurs. Gas locking is more likely to occur as the fluid level at the bottom of a well bore is lowered from pumping action.

To provide pumping to lift fluid out of a well downhole some commonly available pumps include a plunger that is reciprocated through a tubing string by operation of a pump jack. Which plunger includes a check valve assembly, that is generally known as a traveling valve assembly, which traveling valve assembly controls the flow of formation fluid through the plunger on the downstroke. The closure of the traveling valve assembly enables the plunger to lift fluid, on the upstroke.

The traveling valve assembly is opened by a solid column of fluid, on the downstroke, and functions to expel gas that has been entrained in the fluid along with passing the collected fluid. The traveling valve assembly then closes on the upstroke to lift fluid that has passed into the pump barrel. Over the years a number of valve arrangements have been developed as traveling valve assemblies, the present invention being an improvement thereover.

A recent U.S. Pat. No. 4,781,547 to Madden, is an example of a recent development in traveling valve assemblies. This patent cites and distinguishes a number of earlier traveling valve assemblies. All of which earlier traveling valve assemblies, as well as the Madden valve, are subject to failure from hydrostatic pressure present in the pumped fluid. Specifically, earlier valves have generally been found to be unsatisfactory due to their complexity of construction. Or, as to the Madden valve, have experienced failure from clogging due to materials lodging between the free ball and seat, prohibiting valve closure. Such valve failures have constituted a major and expensive problem in that, on valve failure, the entire tubing string must be pulled to effect valve repair or replacement. The neutralizer valve of the present invention provides a very simple valve arrangement whose operation is essentially unaffected by contamination of the crude oil passing therethrough. It is very simple in its construction in that it involves only a guide barrel containing a closure portion that is a ported seal stem whose upper end is tracked to move vertically only. Rather than a ball and seat, the present invention provides a fixed stem collar that is formed around the ported seal stem mid-section that includes a valve face for moving onto and off of a fixed seat that is secured in the guide barrel, passing fluid thereacross, with the ported seal stem the only moving part.

SUMMARY OF THE INVENTION

It is a principal object of the present invention to provide a neutralizer valve for a downhole pump for venting fluid and natural gas, prohibiting failure from formation of a gas lock as can occur during operations of a reciprocating downhole pump.

Another object of the present invention is to provide a neutralizer valve as a gas relief device for mounting in a tubing string in a rod pump that incorporates both a traveling valve and a fixed valve.

Another object of the present invention is to provide a neutralizer valve where the only moving part is a ported seal stem that connects to a pump drag plunger, the stem to move up and down within a guide barrel and includes a collar fixed therearound that is moved into sealing engagement onto a fixed seat that is mounted within the guide barrel, for shutting off flow, and is lifted off that fixed seat to pass fluid therethrough.

Still another object of the present invention is to provide a simple and efficient valve arrangement that is reliable in operation even when passing a crude oil and particulate mixture as would clog other pressure relief valves.

Still another object of the present invention is to provide a neutralizer valve that has few moving parts, is inexpensive to construct and is very reliable for use in downhole pumping operations.

The neutralizer valve of the present invention includes a guide barrel that takes the place of a regular traveling valve in a downhole rod pump. The guide barrel is internally threaded at a top end, for turning onto a plunger, and on its lower end for receiving a threaded seat retainer end turned therein, which retainer maintains a ring seat within the guide barrel. A ported seal stem is maintained and is guided to move up and down within the guide barrel. The stem is internally bored and is ported below a collar portion thereof, which collar portion is formed around the stem mid-portion. The opposite stem end is arranged for coupling to a drag plunger of the rod pump. The ported seal stem collar of the rod pump on an up stroke, seals against the ring seat secured within the guide barrel, blocking fluid passage. On a pump down stroke, the collar moves off the ring seat, allowing flow through the stem ports and across that collar and seat.

DESCRIPTION OF THE DRAWINGS

In the drawings is illustrated that which is presently regarded as the best mode for carrying out the invention.

DETAILED DESCRIPTION

Figures 1, 2:
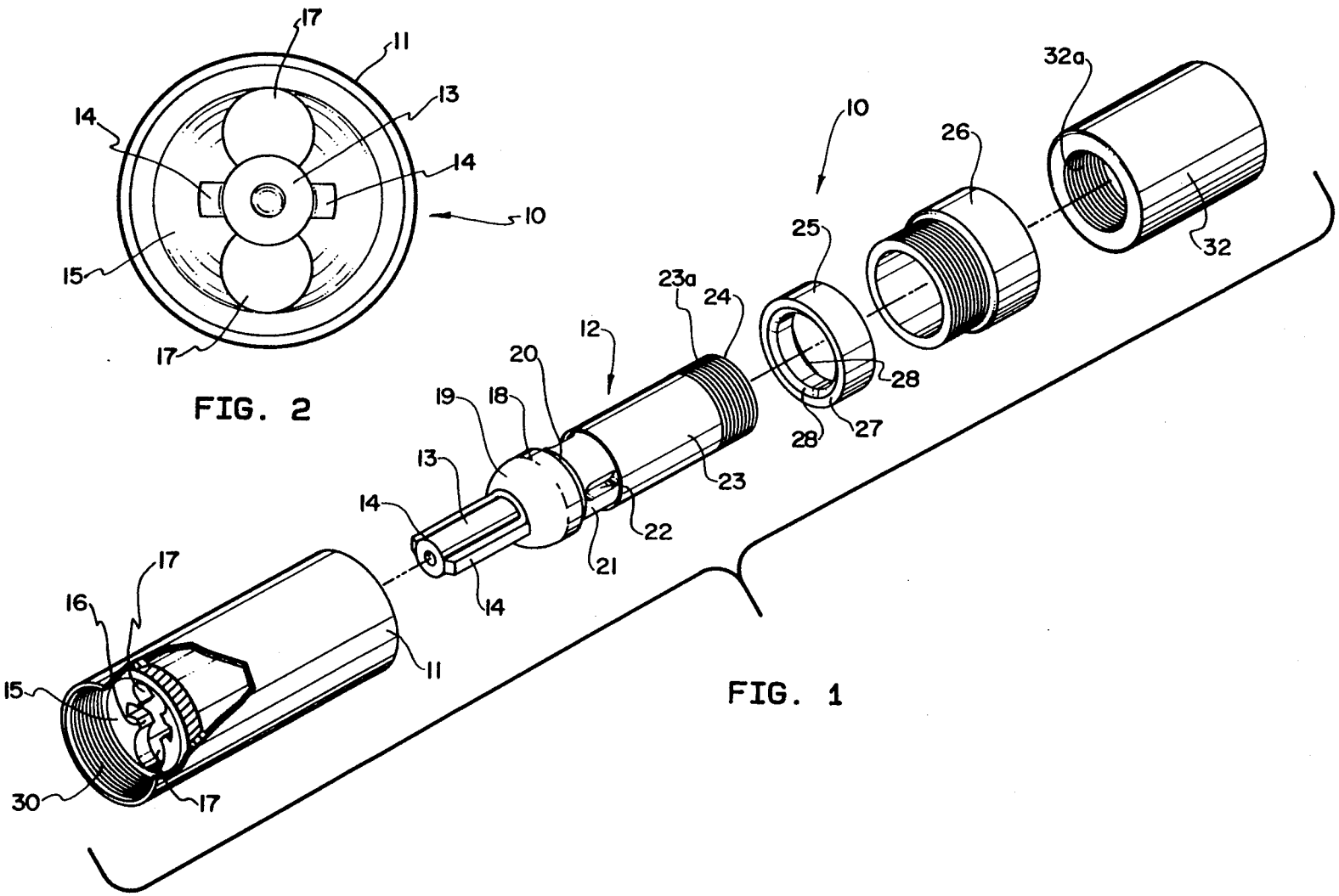
FIG. 1 is an exploded side elevation perspective view of a preferred embodiment of a neutralizer valve of the present invention, showing a section of a guide barrel broken away to expose a ported seal stem guide keyway.
FIG. 2 is a top end view of the guide barrel of the neutralizer valve of FIG. 1.
Figure 3:
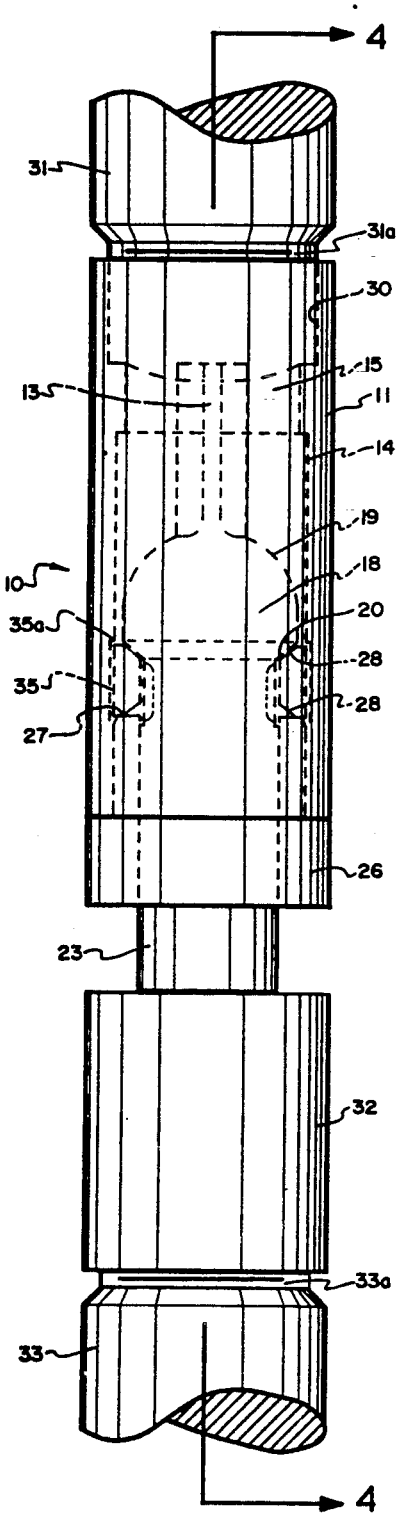
FIG. 3 shows, as a section, the neutralizer valve of FIG. 1 removed from the rod pump, the internal components of the neutralizer valve shown in broken lines.
Figure 4:
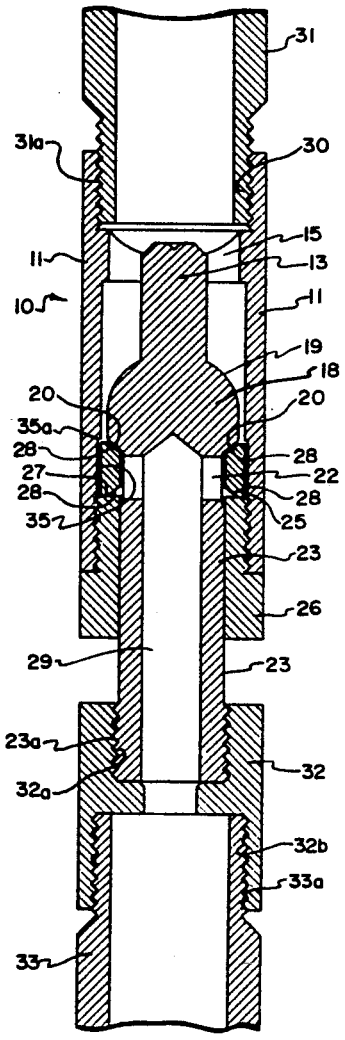
FIG. 4 is a longitudinal sectional view of the section of FIG. 3 showing the rod pump with a pump drag plunger as having been moved in an up stroke.
Figure 5:
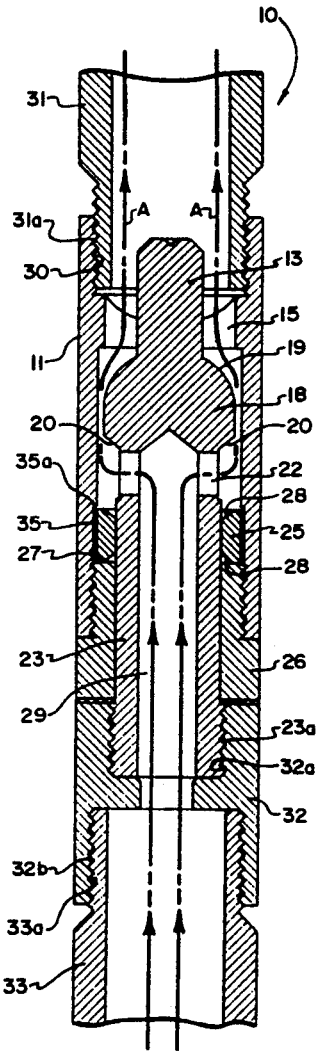
FIG. 5 is a sectional view like FIG. 4, only showing the rod pump and pump drag plunger as having been moved in a down stroke.

FIG. 1 shows an exploded perspective view of a neutralizer valve 10 of the present invention, which valve is shown mounted in FIGS. 3 through 5 in a rod pump. Shown best in FIG. 1, the neutralizer valve 10 consists of a guide barrel 11, that receives a ported seal stem 12 telescoped therein, hereinafter referred to as "stem". The stem 12 includes a guide rod 13 as a top or upper end thereof. The guide rod is keyed by ridges 14 that extend outwardly from and along opposite sides thereof. The key formed by guide rod 13 and ridges 14 is for fitting into and sliding along a keyway 16, that is formed through a disk 15. Which disk 15 is secured across the inside of the guide barrel 11, as shown best in FIG. 2. Ports or holes 17 are also formed through the disk 15, adjacent to and to intersect the keyway 16.

In operation, the stem 12 travels back and forth along keyway 16, the ridges 14 of guide rod 13 guiding that back and forth movement and prohibiting stem rotation. As described in detail hereinbelow, crude oil, that may contain entrained natural gas and foreign materials, such as sand and the like, is pumped up the tubing string. That crude oil passes through the stem 12 and through the ports or holes 17. Which crude oil flow is under pressure and therefor tends to scour out any materials as could lodge between said keyway wall and the stem key, thereby insuring a free up and down travel of the stem 12 in keyway 16.

Shown best in FIG. 1, a collar 18 is formed around the stem guide rod 13, that is immediately adjacent to the ends of ridge 14. The collar 18 has a rounded forward or nose end 19 that intersects the ridges 14 ends, and an outwardly sloping rear end that is a valve face 20. The slope of which valve face 20 terminates in an inwardly necked portion 21 of the guide stem 12. Which necked portion 21 has spaced apart ports 22 formed therein. Ports 22 are open into a longitudinal center passage 29 that is formed in a guide barrel 11 bottom end section 23, which passage 29 opens at the bottom face end 24 of which bottom end section. Stem bottom end section 23 is for telescoping through a ring seat 25 and seat retainer 26. To maintain the ring seat 25 in the guide barrel, the seat retainer 26 is a bushing that is turned into a threaded lower end of the guide barrel 11, as shown in FIGS. 3 through 5, its end butting against a lower face of which ring seat 25. The edge of an opposite face of which ring seat 25 is thereby urged against a wall 35*a* of a stepped section 35 that is formed in the guide barrel lower end, above the threads formed therein.

The ring seat 25 is sloped inwardly and downwardly from a ring cylindrical wall 27 as seat 28. Which slope is the mirror image of the sloping surface of the valve face 20, and is for juxtapositioning thereto. To prohibit misassembly of the neutralizer valve 10, the ring seat 25 is sloped inwardly and downwardly at opposite faces, forming identical seats 28.

With the valve face 20 engaging the seat 28, as when the tubing string is in an up stroke, as illustrated in FIG. 4, fluid passage through the longitudinal passage 29 in stem 12 and ports 22 is blocked. With the stem moved upwardly, as when the rod pump is in a down stroke, fluid passage is allowed across the valve face 20 and seat 28, through the passages 17 in the disk 15 and up the tubing string, as shown in FIG. 5.

As set out above, the up and down movement of the stem 12 within the guide barrel 11 causes the valve face 20 to move off of and onto the seat 28, opening and closing the neutralizer valve during up and down strokes of the tubing string. For connection onto the rod pump plunger the neutralizer valve 10, as shown best in FIG. 1, is internally threaded at 30 at the upper end of guide barrel 11, adjacent to and above the disk 15, for turning onto a threaded end 31*a* of a rod pump plunger 31. The stem 12 is threaded at 23*a* at its bottom end section 23, adjacent to bottom end face 24, to receive a threaded end 32*a* of a coupling 32 turned thereover, as shown in FIGS. 3 through 5. Which coupling 32 is also internally threaded at its opposite end 32*b* to receive an externally threaded end 33*a* of a drag plunger 33. Which drag plunger 33, it should be understood, is part of the rod pump for pumping crude oil up to and through the neutralizer valve 10.

In practice, the neutralizer valve 10 is suitable for use with downhole pumps of the reciprocating type where a pump jack unit provides for lifting and lowering a tubing string to operate one or more downhole pumps, with at least a pump incorporating the neutralizer valve 10 with a drag plunger that is coupled to stem 12.

The neutralizer valve 10, of the present invention is connected, as described, into the tubing string, in a downhole rod pump, and receives a mix of crude and natural gas that passes through the valve on a down stroke, as illustrated by flow arrows A in FIG. 5. Which flow is through the opening in bottom end face 24 of the stem 12, and passes out through ports 22, and across the valve face 20 and seat 28, from where the flow travels up and out of the guide barrel 11. Whereas, on an upstroke, as illustrated in FIG. 4, the guide stem 12 is moved relative to the guide barrel 11 to where the stem collar valve face 20 contacts and seals against seat 28, closing off flow. The movement of which stem 12 is guided by the ridges 14, that with the guide rod 13, form a key that travels up and down along keyway 16 that is formed through the disk 15. With the neutralizer valve 10 closed, as set out above, fluid above the valve can continue up the tubing string, with fluid below the valve face 20 and seat 28 contained until a next down stroke.

While a preferred embodiment of the present invention in a neutralizer valve has been shown and described herein, it should be understood that the present disclosure is made by way of example only and that variations and changes thereto are possible without departing from the subject matter and reasonable equivalency thereof coming within the scope of the following claims, which claims I regard as my invention.

I claim:

1. A valve device for use in conjunction with a reciprocating downhole pump comprising, a guide barrel with means for connecting an upper end thereof onto a rod pump, and including a ported interior disk that is arranged across the guide barrel interior and has an opening formed therethrough, with a lower guide barrel end arranged to couple to a seat retainer means fitted thereto; a seat retainer means for coupling to said guide barrel for maintaining a seat means in said guide barrel; a seat means; a ported seal stem arranged for telescoping into said guide barrel, the upper end thereof for traveling back and forth within said interior disk opening which ported seal stem includes a collar that is formed around a mid-portion thereof, which collar has a valve face formed around its lower end that, in the assembled valve device is juxtapositioned to said seat means for sealing thereagainst, and said ported seal stem is ported below said collar, into a longitudinal passage, that is formed therein to stem bottom end face; and means for coupling said ported seal stem lower end to a drag plunger of a downhole pump.

2. A valve device as recited in claim 1, wherein interior disk opening is a keyway; and the ported seal stem is formed into a key end consisting of a rod having ridge means secured to extend outwardly from along opposite sides thereof said ridge means extending the length of said rod, which ridge means are fitted in said disk keyway to guide ported seal stem travel and to prohibit rotation of that ported seal stem during its up and down travel within the guide barrel.

3. A valve device as recited in claim 1, wherein the ported seal stem collar is rounded at a head or top end thereof, and which ported seal stem is necked inwardly below said collar, which said necked portion is ported at spaced intervals therearound; and a lower end of which ported seal stem is externally threaded for receiving a coupling sleeve turned thereover, which coupling sleeve couples to the drag plunger of the downhole pump.

4. A valve device as recited in claim 1, wherein the guide barrel is a cylinder that is internally threaded at both ends for turning onto a rod pump plunger at its upper end and for receiving the seat retainer means turned into its lower end; and the interior disk keyway and ports are formed to intersect.

5. A valve device as recited in claim 4, wherein the seat retainer means is a bushing that is threaded on one end to turn into the guide barrel lower end, the upper seat retainer means end to engage and maintain a ring seat in said guide barrel; and said ring seat is sloped from the ring seat exterior wall inwardly and downwardly into a flat surface as the seat means.

6. A valve device as recited in claim 5, wherein the seat means and the ported seal stem collar valve face are mirror images; and seat means is formed in both upper and lower faces of the ring seat.

* * * * *